US007779801B2

(12) United States Patent
Kleiber et al.

(10) Patent No.: US 7,779,801 B2
(45) Date of Patent: Aug. 24, 2010

(54) CAMSHAFT ADJUSTER FOR AN INTERNAL COMBUSTION ENGINE

(75) Inventors: Thomas Kleiber, Wahlschied (DE); Rainer Ottersbach, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 484 days.

(21) Appl. No.: 11/722,226

(22) PCT Filed: Nov. 12, 2005

(86) PCT No.: PCT/EP2005/012157

§ 371 (c)(1),
(2), (4) Date: Jun. 20, 2007

(87) PCT Pub. No.: WO2006/074747

PCT Pub. Date: Jul. 20, 2006

(65) Prior Publication Data

US 2009/0272350 A1 Nov. 5, 2009

(30) Foreign Application Priority Data

Dec. 23, 2004 (DE) ..... 10 2004 062 070

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17, 90.18, 90.31
See application file for complete search history.

(56) References Cited

U.S. PATENT DOCUMENTS

| | | | | |
|---|---|---|---|---|
| 2,111,590 | A | 3/1938 | Hoof | |
| 5,724,928 | A * | 3/1998 | Morii et al. | 123/90.17 |
| 6,669,567 | B1 | 12/2003 | Scheidt et al. | |
| 7,484,486 | B2 * | 2/2009 | Knecht et al. | 123/90.31 |

FOREIGN PATENT DOCUMENTS

| | | |
|---|---|---|
| DE | 3830382 | 1/1990 |
| DE | 10211607 | 10/2003 |
| FR | 2161284 | 7/1973 |
| GB | 1407841 | 9/1975 |

* cited by examiner

*Primary Examiner*—Zelalem Eshete
(74) *Attorney, Agent, or Firm*—Volpe and Koenig, P.C.

(57) ABSTRACT

A camshaft adjuster (1) for an internal combustion engine is provided, which includes a housing (21) and in which a relative angular position between a driving gear (22') and an output element allocated to the camshaft is adjustable. In a first connection region (28), the housing is connected in a fixed manner to a support element (20) which is connected in a fixed fashion to a plastic toothed ring (19) in a radially outward direction in a second connection region (29). The outer surface of the carrier element (20) fits an inner surface of the toothed ring (19) in the second connection region (29). The carrier element (20) makes it possible to bridge the radial gap between the toothed ring (19) and the outer surface of the housing (21), and the second connection region accurately predefines a position of the toothed ring (19).

11 Claims, 3 Drawing Sheets

CAMSHAFT ADJUSTER FOR AN INTERNAL COMBUSTION ENGINE

BACKGROUND

The invention relates to a camshaft adjuster for an internal combustion engine according to the preamble of claim 1.

From DE 102 11 607 A1, a camshaft adjuster for adjusting and fixing the relative rotational angle position of a camshaft relative to the crankshaft of an internal combustion engine is known. A hydraulic adjustment device here consists of an external rotor, which is allocated to a drive wheel, and also an internal rotor, which is connected to a camshaft via a driven element. Pressure chambers are formed between the external rotor and the internal rotor. Charging these chambers hydraulically can change the angular relationship between the drive wheel and driven element.

In the mentioned publication, it is proposed to produce the drive wheel and at least one of the other functional parts integrally from a high load capacity plastic. According to a first embodiment, the drive wheel and the external rotor and also two other components are produced integrally from plastic. For an alternative construction, the external rotor is produced as a separate component from plastic or from a conventional material, such as metal, and is set in a cover formed integrally with the drive wheel.

SUMMARY

The invention is based on the objective of providing a camshaft adjuster, which is functionally ready or optimized for good production possibilities, having a small number of components, and/or low weight.

According to the invention, the objective is met by the features of the independent claim 1.

According to the invention, a housing is provided, which is optionally multifunctional:

- The housing can be used for attaching the camshaft adjuster to the internal combustion engine, for example, in the area of a cylinder head.
- The housing can support internal elements of the camshaft adjuster, for example, gear elements or hydraulic components.
- The housing can protect the inner components against mechanical impairments or contaminants from the outside.
- The housing can be sealed tight, in order to keep lubricant or hydraulic medium arranged in the housing in the housing.
- For the case that the housing includes electrically powered elements, the housing can provide electrical shielding.
- The housing can also be used for supporting a control unit arranged outside of the housing, which is connected via a suitable drive shaft to gear elements of the camshaft adjuster.
- The housing can have through holes, optionally sealed, for example, by a radial shaft sealing ring or the like, for passage of a shaft, for example, in connection with the camshaft or a shaft of the drive unit.

Here, the housing can be produced with any production method, which allows for the previously mentioned functions. As possible materials for a housing, any material, especially a metal or a plastic, can be used. The possible production methods involve, for example, a casting method, an injection molding or die-casting method, and/or a shaping method.

According to the invention, the housing has another function: in a first connection region, the housing is connected rigidly to a carrier element. In this way, the housing is also used for attaching the carrier element. The carrier element is connected rigidly to a toothed ring, in addition to the attachment to the housing, in a second connection region. Instead of a one-piece construction of the housing or toothed ring or an attachment of the toothed ring directly on the housing, according to the invention a carrier element is connected between the housing and toothed ring in the force flow.

The invention is further based on the knowledge that the use of a toothed ring made from any plastic, especially a duroplastic, a thermoplastic, or a composite plastic, is advantageous in terms of the running properties, the operating strength, the wear, the noise development, the force transmission, the material or production costs, the installation space, and/or the weight.

The housing, the carrier element, and the toothed ring can be selected from the same or different materials and can be produced with the same or different production methods, wherein the material and the production method can be selected according to the relevant requirements. For example, the toothed ring can be produced with a high precision guaranteeing good force transmission, while lower demands are possibly placed on parts of the carrier element.

On the other hand, connection regions according to the invention are provided, which guarantee a selective attachment of the carrier element in one region to the housing and in another region to the toothed ring.

In the second connection region between the toothed ring and carrier element, the carrier element has an outer casing surface, which is formed corresponding to an inner casing surface of the toothed ring. In connection with this, a corresponding construction is understood to be any positive-fit or non-positive fit surface shape, at least in one spatial direction:

- In particular, the casing surfaces involve cylindrical surfaces, which are supported against each other. Here, the inner casing surface of the toothed ring and the outer casing surface of the carrier element can be formed as a press fit, transition fit, or small clearance fit. In such a case, the second connection region must automatically ensure that the alignment of the toothed ring, which is important for good running of a drive belt or a drive chain, is guaranteed as a result of the corresponding casing surfaces. On the other hand, the inner casing surface of the toothed ring can be supported possibly over a large surface when the camshaft adjuster is operating over the outer casing surface of the carrier element, so that a rigid support is given while maintaining the necessary orientation of the toothed ring. Here, the mentioned casing surfaces can satisfy the mentioned support or centering effect only during an assembly of the camshaft adjuster, while after the assembly, a non-positive fit or else additional attachment elements support the connection between the carrier element and toothed ring.
- Alternatively or additionally, the carrier element and toothed ring can engage each other with a positive fit, for example, by means of radial projections or shoulders allocated to one of the components named above, which engage in radial recesses or grooves of the other component in the peripheral direction and/or in the longitudinal direction. In this case, the use of elastic materials, for example, a plastic for the toothed ring, can be advantageous for the assembly and disassembly of the positive-fit connection, because these can be deformed elastically in the radial direction for producing and detaching the positive-fit connection. It is especially advantageous when the material that is used, especially a composite material, has anisotropic elasticity properties with a given elasticity in the radial direction for allowing the assembly or disassembly and a reduced elasticity in the longitudinal direction and/or peripheral direction, so that good force transfer is guaranteed between the toothed ring and carrier element. Also conceivable is that the positive fit is produced under the use of thermal deformation in the radial direction.

According to the invention, the radius of the first connection region is smaller than the radius of the second connection region. Thus, the carrier element covers the region between the radius of the first connection region and the radius of the second connection region. Such bridging of this region by the carrier element can be implemented possibly with a carrier element with small extent in the direction of the longitudinal axis of the camshaft adjuster. Alternatively or additionally, a body closed in the peripheral direction and running around the longitudinal axis of the camshaft adjuster does not absolutely have to be provided for the carrier element, but instead only individual carrier arms or a circular ring surface with suitable recesses can possibly be used, whereby a reduction in the weight and a reduction in the mass moment of inertia can be achieved, while bodies running typically in the peripheral direction are required for the housing and the toothed ring.

The surfaces of the housing, carrier element, and toothed ring involved in the connection regions can be produced directly according to requirements or can be brought to a desired dimension in a later processing step.

A carrier element that is particularly easy to produce for a camshaft adjuster according to the invention is produced when the carrier element is rotationally symmetric to a longitudinal axis of the camshaft adjuster. Such a carrier element can be produced, for example, in an injection molding process or in a molding process. Another advantage of a rotationally symmetric construction of the carrier element is that such a carrier element does not present an unbalanced mass for the camshaft adjuster, which has advantages for an operation of the camshaft adjuster, especially at high rotational speeds. In this way, the requirement of possible compensation masses for compensating for an unbalanced mass can be met.

According to one improvement of the invention, the carrier element is formed with a hollow cylindrical contact connecting piece, whose inner casing surface is part of the first connection region. This inner casing surface can contact the housing over a large surface during the assembly or operation of the camshaft adjuster, whereby the orientation of the carrier element relative to the housing is set by the inner casing surface.

Alternatively or additionally, the carrier element has a hollow cylindrical outer body, with whose outer casing surface the second connection region is formed. On this outer casing surface, the toothed ring can contact a corresponding, especially cylindrical, inner surface with an exact fit, whereby a position and orientation of the toothed ring relative to the carrier element (and possibly relative to the housing) is given. Also conceivable is a positive fit between the casing surface and the inner surface.

According to one special construction of the camshaft adjuster according to the invention, the outer body and the contact connecting piece are connected to each other via a circular ring-shaped carrier body. Such a circular ring-shaped carrier body provides, for low material use and low extent in the direction of the longitudinal axis of the camshaft adjuster, a bridge from the radius of the first connection region from the housing to the radius of the second connection region of the toothed ring.

According to one preferred construction of the camshaft adjuster, non-positive fit connections between the carrier element and the housing or the toothed ring are provided in the first connection region and/or second connection region. According to this construction, the mounting positions are given by the corresponding casing surfaces of the carrier element, the toothed ring, and/or the housing. Final fixing of the components named above is performed by producing the non-positive fit connection, which guarantees an especially reliable connection when the camshaft adjuster is operating.

Alternatively or additionally, in the second connection region the toothed ring can be connected to the carrier element with a friction fit or positive fit. For example, the toothed ring can be shrunk onto the carrier element or a transmission of the drive forces of a drive wheel can be realized with a positive fit by means of radial projections and/or recesses in the carrier element and also the toothed ring.

Preferably, the toothed ring has a shoulder in the longitudinal direction. Such a shoulder can be used as a stop during assembly, so that the shoulder sets the maximum mounting position of the toothed ring relative to the carrier element. Accordingly, the shoulder is used for setting an end position of the toothed ring relative to the carrier element in a direction of the longitudinal axis of the camshaft adjuster. Alternatively or additionally, the shoulder can also set an angular position of the toothed ring, for example, about an axis that is oriented perpendicular to the longitudinal axis of the camshaft adjuster. Here, the shoulder noted above contacts a corresponding counter surface or end face of the carrier element.

An outer body of the carrier element can also have a radially outwardly oriented shoulder or projection. At least for mounting, the toothed ring can contact this shoulder or projection for setting the relative position between the carrier element and toothed ring. Alternatively or additionally, such a shoulder can be used for guiding a drive means, such as a toothed belt or a toothed chain.

Furthermore, it is allowed according to the invention that the toothed ring has a radially inwardly directed projection extending at least partially in the peripheral direction. This is then advantageous when the toothed ring is not to contact the carrier element over its entire axial width. The circular projection then has, e.g., a radial inner casing surface, with which the second connection region is formed, optionally under the intermediate connection of non-positive fit material. Here, it is also possible that the projection is first produced with an over-measure, which is still too small for mounting due to the inner diameter of the inner casing surface, and in a subsequent production step the projection is brought to a dimension allowing the mounting and attachment to the toothed ring.

A good attachment of the toothed ring to the carrier element is further produced when the toothed ring has at least one radially inwardly oriented projection, which is held with a positive fit in a suitable recess or groove of an outer body of the carrier element.

BRIEF DESCRIPTION OF THE DRAWINGS

Additional features of the invention emerge from the following description and the associated drawings, in which embodiments of the invention are presented schematically. Shown are.

DETAILED DESCRIPTION OF THE PREFERRED EMBODIMENTS

Figure 1:
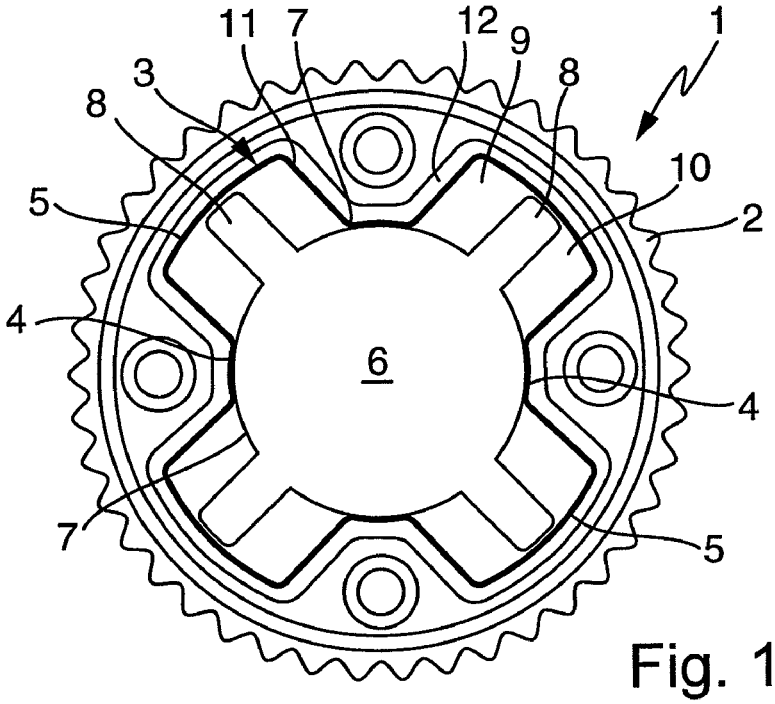
FIG. 1 a cross-sectional view of a part of a camshaft adjuster with an outer rotor and a carrier body made from plastic with a non-positive fit connected insert body and also an inner rotor supported rotatably in the outer rotor.

The invention relates to a hydraulic camshaft adjuster 1 of a known construction. The camshaft adjuster has a drive wheel 2, which is formed as a pulley in the shown embodiments. An outer rotor 3, which is arranged, in particular, radially inwardly from the drive wheel 2, is connected rigidly to the drive wheel 2. The outer rotor 3 is formed with bearing surfaces 4, which correspond to segments of a casing surface of a cylinder, and also radial bulges for pressure chambers 5. According to the embodiment shown in FIG. 1, four bearing surfaces 4 and also four pressure chambers 5 are provided, which are distributed uniformly about the periphery. An inner rotor 6, which can be locked or is locked in rotation with the camshaft, is arranged in the outer rotor 3 so that it can rotate relative to this outer rotor about a longitudinal axis of the camshaft adjuster 1. The inner rotor 6 has bearing surfaces 7 formed corresponding to the bearing surfaces 4 of the outer rotor 3 and also has vane-like radial projections 8, wherein four bearing surfaces 7 and four projections 8 are provided, which are distributed uniformly around the periphery of the inner rotor, according to the embodiment shown in FIG. 1. The bearing surfaces 4 and 7 form a seal in the peripheral direction and the end faces of the projections 8 contact the associated pressure chambers 5 forming a seal radially on the outside, so that in the peripheral direction pressure spaces 9, 10 are formed on both sides of the projections. Through suitable charging of the pressure spaces 9, 10, the relative angular position between the outer rotor 3 and the inner rotor 6 can be changed, whereby the angular relationship between the drive wheel 2 and a camshaft can be changed for adjusting the opening times of valves.

According to FIG. 1, both the pressure chambers 5 and also the bearing surfaces 4 are both formed with a metallic insert body 11, which extends in the peripheral direction and which has an approximately constant wall thickness. The insert body 11 is held with a non-positive fit in a carrier body 12, which according to the embodiment shown in FIG. 1 is formed integrally with the drive wheel 2 or is formed as a separate component, which can be connected rigidly to the drive wheel 2.

Figure 2:
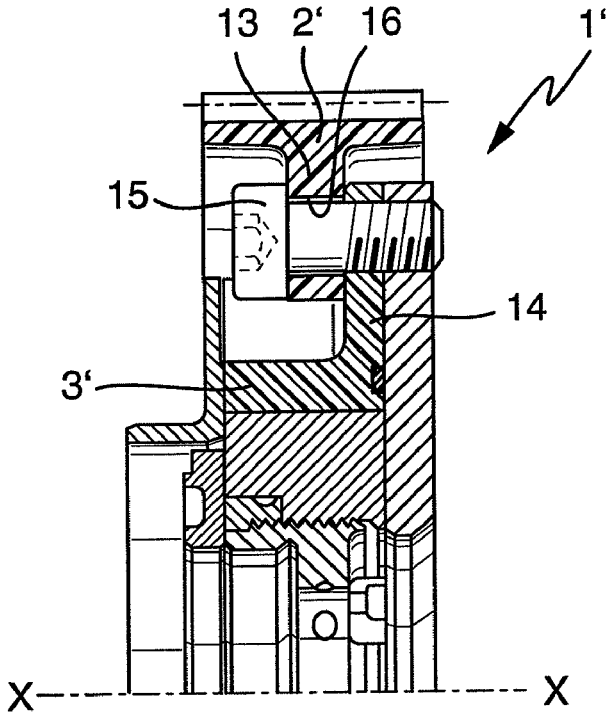
FIG. 2 a longitudinal cross-sectional half view of a camshaft adjuster in which the drive wheel made from plastic or an attachment element is attached to a flange.
Figure 3:
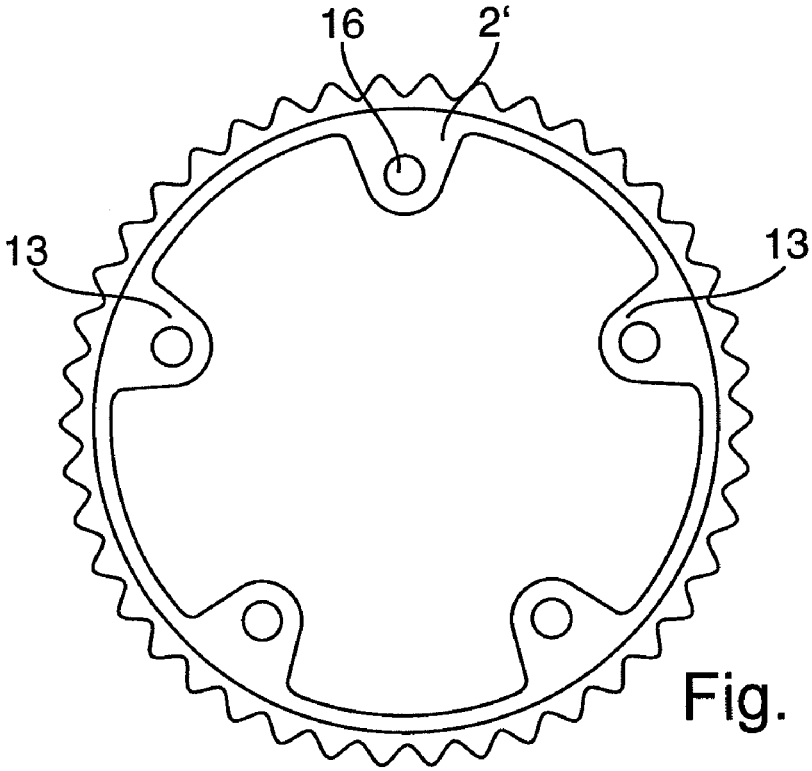
FIG. 3 a view of a drive wheel made from plastic with radially inwardly pointing brackets for receiving attachment elements.
Figure 4:
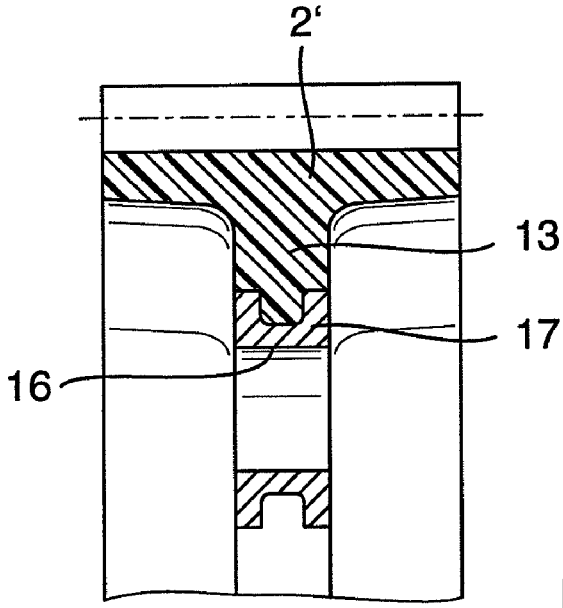
FIG. 4 a longitudinal cross-sectional half view of a drive wheel with a connecting piece or a bracket and inserts inserted into the connecting piece or bracket.
Figure 5:
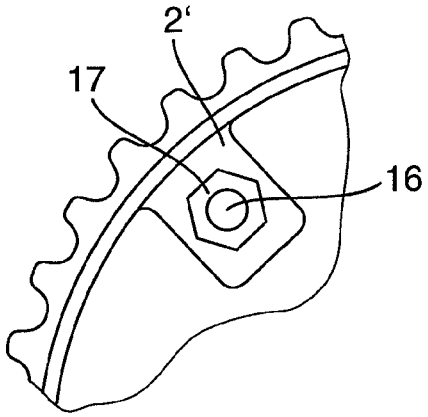
FIG. 5 a partial cross-sectional view of a drive gearwheel with radially inwards pointing brackets and inserts arranged in these brackets.

FIG. 2 shows a camshaft adjuster 1' in longitudinal section. For this camshaft adjuster, the drive wheel 2' is formed integrally with inwardly projecting brackets 13, which are arranged approximately in the middle in the axial direction, which extend in the direction of a longitudinal axis X-X of the camshaft adjuster 1' over one third to one fourth of the width of the running gearing of the drive wheel 2', and which are distributed uniformly over the periphery, cf. FIG. 3. A flange 14, which is formed integrally with the outer rotor 3', contacts an end of the brackets 13. The brackets 13 and the flange 14 are connected to each other with a friction, positive, and/or firmly bonded fit and/or via attachment elements 15, which are formed as screws according to FIG. 2. Here, the brackets 13 and also the flange 14 have suitable bores 16 with or without threading. The bores 16 with or without threading can here be formed directly in the material forming the drive wheel or are prepared according to FIG. 4 by reinforcement intermediate layers 17, especially inserts, for example, made from metal, which are attached preferably with a firmly bonded fit to the other integral elements of the drive wheel 2.

In terms of the drive wheel 2, the outer rotor 3, the bearing surface 4, the inner rotor 6, the bearing surface 7, the projections 8, the insert body 11, the carrier body 12, the brackets 13, and/or the flange 14, there are the following shaping possibilities:

- The components named above can be made from any plastic or from a fiber composite material. In particular, a thermoplastic or a duroplastic of any composition can be used.
- Furthermore, any composite material can be provided, for example, a plastic with an iron metal or a non-iron metal. In terms of the thermal expansion coefficients, these can be adapted to each other mutually, so that, for example, plastic, fiber composite materials, or composite materials have equal thermal expansion coefficients, such as adjacent components made from different materials. In particular, components arranged on the driven side, that is, components connected rigidly to the camshaft, can have a greater thermal expansion coefficient than components arranged on the drive side.
- The components named above can be joined to form units in one or more pieces. For example, the drive wheel 2, the outer rotor 3, the bearing surface 4 with insert body 11, bracket 13, and carrier body 12, as well as flange 14 are formed as an integral, installation space-optimized component made from one or more materials or composite materials.
- For weight reduction and for improving the mounting possibilities, pockets can be provided in the components named above.
- The drive wheel 2 and insert body 11 can be connected to each other optionally under the intermediate connection of additional (sub) bodies with a positive fit, for example, by screws, with a form fit, for example, by rivets, or with a non-positive fit, for example, by adhesive, injection molding, or integral production, wherein combinations of the connection possibilities named above are conceivable.
- Non-plastic elements can be used as aids for the screw connection, for example, based on a "mold-in" or "after-molding" technology. A "mold-in" technology involves, for example, a metal bushing with threading, which is injection molded in a die, while as an example for an "after-mold" technique, a metal bushing with threading is conceivable, which is inserted in a plastic part after the injection-molding process.
- Metallic elements or sub-bodies can be formed as reinforcement material in other materials, for example, for homogenizing the expansion and/or for bracing, for forming support material, and for increasing the component stiffness.

A selection of materials and their orientation can be used as thermal construction parameters, in which the expansion coefficient can be set to a desired target according to the element and its volume percentage.

The use of reinforcement intermediate layers or inserts can be used, in particular, for minimizing setting force losses and for permitting direct screw connections.

According to FIG. 1, the outer rotor can be embedded directly into a plastic material. Assembling this plastic material with the outer rotor can be realized directly, for example, in an injection molding process or else by means of a later assembly.

Figure 6:
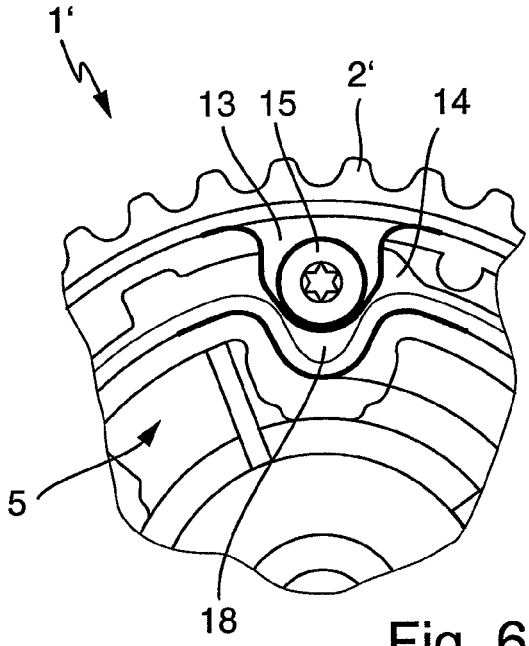
FIG. 6 a cross-sectional view of a camshaft adjuster, wherein attachment elements are drawn radially inwardly, so that their spacing from the longitudinal axis of the camshaft adjuster is smaller than the outer diameter of the pressure chambers, and FIG. 7 a view of a drive gearwheel made from plastic, which is attached to a housing of the camshaft adjuster via a carrier element.

FIG. 6 shows a partial cross section allocated to the embodiment according to FIG. 2. From here it is visible that the flange 14 does not have circular outer contours, but instead projects radially outwards in the connection region to the brackets 13. Furthermore, it can be seen that the outer rotor 3 has sub-regions with the pressure chambers 5, which project radially outwards and the attachment elements 15 are connected to the outer rotor 3 in the region of recesses 18 or radially inwards oriented pockets. In this way, the attachment elements 15 can be "pulled down" to small radii, so that the attachment elements 15 act at a radius that lies in a region of the outer diameter of the pressure chamber 5 or that is smaller than this. Here, the attachment elements 15, the brackets 13, and an optional flange 14 are provided axially between the end faces of the drive wheel 2', so that a small axial installation size is produced.

Figure 7:
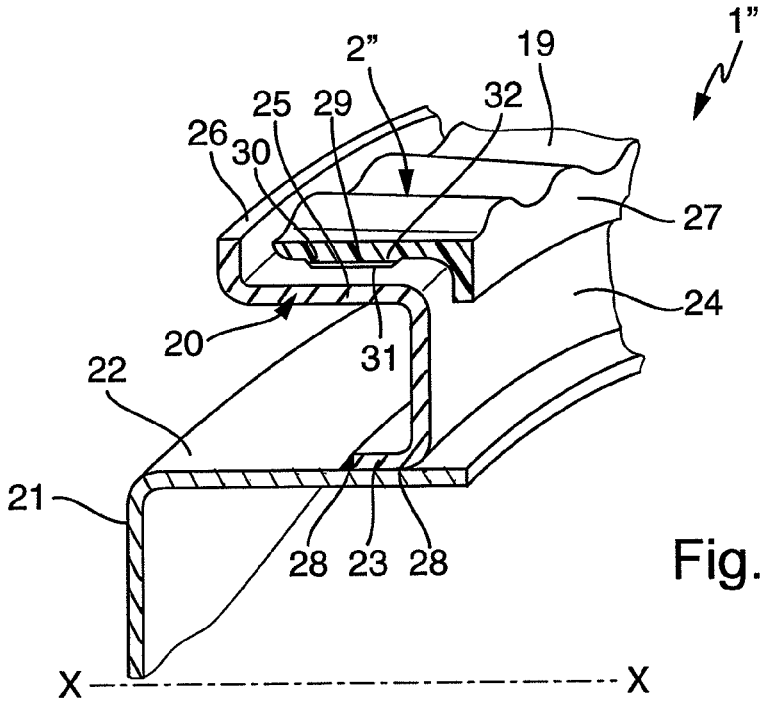

FIG. 7 shows an example construction for a drive wheel 2" with allocated components, here a toothed ring 19, a carrier element 20, and a housing 21.

The housing 21 is formed especially as a sheet-metal part with an approximately cylindrical casing surface 22 and includes additional components of the camshaft adjuster 1". The carrier element 20 is supported rigidly on the casing surface 22, especially by a firmly bonded connection. Here, the carrier element 20 has a hollow cylindrical contact connecting piece 23, which contact the casing surface 22 radially at the inside and is connected to the housing 21 with a firmly bonded fit on at least one axial end face. The contact connecting piece 23 transitions, especially under the intermediate connection of a transition radius, into a circular disk-shaped carrier body 24, which is oriented coaxial to the longitudinal axis X-X and which, in turn, transitions in a hollow cylindrical outer body 25 with a surrounding shoulder 26 or collar in the end region opposite the carrier body 24.

The toothed ring 19 contacts the shoulder 26 in the region of an axial end face, while the opposite end of the toothed ring 19 has a radially inwardly projecting radial projection 27, which contacts the carrier body 24 or the transition region between the carrier body 24 and outer body 25. The toothed ring 19 has radially on the inside, especially approximately in the middle, a surrounding projection or connection region 29 provided across partial-peripheries, which extends approximately over half the width of the toothed ring 19. The connection region 29 is connected to the outer casing surface of the outer body 25 with a firmly bonded fit. The toothed ring 19 can also be connected to the carrier body 24 with a friction fit or positive fit in the connection region 29.

For the toothed ring 19, the carrier element 20, and the housing 21, all of the previously mentioned materials or material combinations can be used. As an example embodiment, a production of the toothed ring 19 from plastic, especially a duroplastic, is conceivable, while the carrier element 20 and the housing 21 are produced from a metal.

The shoulder 26 can be used alternatively or additionally for simplifying the mounting of a guide of a drive element like a toothed belt or a control chain in the direction of the longitudinal axis X-X.

The outer body 25 has on its outer casing surface preferably recesses 31 or depressions or grooves, which can be formed as pockets in the outer body or can pass through this body. For the shown embodiment, the recesses 31 are formed with an approximately rectangular cross section. Radially inwardly oriented projections 32 or a surrounding collar extend radially inwards from the toothed ring 19, especially form the projection 30. These projections are held with a positive fit at least in the longitudinal direction X-X and/or in the peripheral direction in the recess 31, depression, or groove. In the radial direction, the toothed ring 19 can be guided opposite the carrier element 20 through the projection 30 and/or projection 32.

LIST OF REFERENCE SYMBOLS

1 Camshaft adjuster
2 Drive wheel
3 Outer rotor
4 Bearing surface of outer rotor
5 Pressure chamber
6 Inner rotor
7 Bearing surface of inner rotor
8 Projections
9 Pressure space
10 Pressure space
11 Insert body
12 Carrier body
13 Bracket
14 Flange
15 Attachment element
16 Bore
17 Reinforcement insert
18 Recess
19 Toothed ring
20 Carrier element
21 Housing
22 Casing surface
23 Contact connecting piece
24 Carrier body
25 Outer body
26 Shoulder
27 Projection
28 First connection region
29 Second connection region
30 Projection
31 Recess
32 Projection

The invention claimed is:

1. Camshaft adjuster for an internal combustion engine, comprising a drive wheel and a driven element in which a relative angular position between the drive wheel and the driven element, which is allocated to a camshaft, is adjustable and which has a housing that is connected rigidly in a first connection region to a carrier element, which is connected rigidly in a second connection region to a toothed ring made from plastic, wherein a radius of the first connection region is smaller than a radius of the second connection region and in the second connection region an outer casing surface of the carrier element extends axially and is formed corresponding to an inner casing surface of the toothed ring.

2. Camshaft adjuster according to claim 1, wherein the carrier element is formed rotationally symmetric to a longitudinal axis of the camshaft adjuster.

3. Camshaft adjuster according to claim 2, wherein the carrier element has a hollow cylindrical contact connecting piece and the first connection region is formed with an axially extending inner casing surface of the contact connection piece.

4. Camshaft adjuster according to claim 3, wherein the carrier element has a hollow cylindrical outer body and the second connection region is formed with the outer casing surface of the outer body.

5. Camshaft adjuster according to claim 1, wherein a firm connection is provided between the carrier element and the housing or the toothed ring in the first connection region and/or second connection region.

6. Camshaft adjuster according to claim 1, wherein the toothed ring is connected to the carrier element with a friction fit or positive fit in the second connection region.

7. Camshaft adjuster according to claim 1, wherein the toothed ring has a projection, which contacts the carrier element at least during mounting and sets a relative position between the carrier element and the toothed ring.

8. Camshaft adjuster according to claim 1, wherein an outer body of the carrier element has a radially outwardly oriented shoulder or projection.

9. Camshaft adjuster according to claim 1, wherein the toothed ring has a radially inwardly oriented projection, which extends in a peripheral direction about a longitudinal axis of the camshaft adjuster and which contacts an outer body of the carrier element over an entire surface in the second connection region.

10. Camshaft adjuster according to claim 1, wherein the toothed ring has at least one radially inwardly oriented projection, which is held with a positive fit in a recess or depression of an outer body of the carrier element.

11. Camshaft adjuster for an internal combustion engine, comprising a drive wheel and a driven element in which a relative angular position between the drive wheel and the driven element, which is allocated to a camshaft, is adjustable and which has a housing that is connected rigidly in a first connection region to a carrier element, which is connected rigidly in a second connection region to a toothed ring made from plastic, a radius of the first connection region is smaller than a radius of the second connection region and in the second connection region an outer casing surface of the carrier element is formed corresponding to an inner casing surface of the toothed ring, the carrier element is formed rotationally symmetric to a longitudinal axis of the camshaft adjuster, the carrier element has a hollow cylindrical contact connecting piece and the first connection region is formed with an inner casing surface of the contact connection piece, the carrier element has a hollow cylindrical outer body and the second connection region is formed with the outer casing surface of the outer body, and the outer body and the contact connecting piece are connected to each other by a circular ring-shaped carrier body.

* * * * *